United States Patent [19]

de Cubas et al.

[11] 4,381,865

[45] May 3, 1983

[54] GEOMETRIC DOMINO-TYPE GAME

[76] Inventors: Mercedes Z. de Cubas; Luis A. de Cubas, both of 5025 Sheridan Ave., South, Minneapolis, Minn. 55410

[21] Appl. No.: 282,860

[22] Filed: Jul. 13, 1981

[51] Int. Cl.[3] ..... A63F 9/20

[52] U.S. Cl. ..... 273/294; 273/148 A; 273/150

[58] Field of Search ..... 273/148 A, 294, 299, 273/150; 434/171, 280

[56] References Cited

U.S. PATENT DOCUMENTS

| | | | |
|---|---|---|---|
| 2,222,245 | 11/1940 | Steen | 273/148 A UX |
| 2,937,874 | 5/1960 | Ellison | 273/294 |
| 3,333,351 | 8/1967 | Williams | 273/294 X |
| 3,773,327 | 11/1973 | Kremer | 273/294 |
| 3,924,859 | 12/1978 | Kramer | 273/294 |

FOREIGN PATENT DOCUMENTS

| | | | |
|---|---|---|---|
| 2625584 | 4/1978 | Fed. Rep. of Germany | 434/171 |

*Primary Examiner*—Anton O. Oechsle

*Attorney, Agent, or Firm*—Burd, Bartz & Gutenkauf

[57] ABSTRACT

Apparatus for playing a domino-type game comprising a plurality of domino-like pieces intended to be joined end-to-end or end-to-side. Each of the game pieces is structurally distinctive and different from each other game piece. Each of the game pieces has one of a plurality of different interfitting geometric configurations at at least one end which is matable with a complementary geometric configuration in the end or side of another game piece to connect adjacent pieces. Numerical values may be assigned to particular geometric configurations. The game pieces are preferably packaged in a dispensing receptacle.

12 Claims, 12 Drawing Figures

GEOMETRIC DOMINO-TYPE GAME

BACKGROUND OF THE INVENTION

1. Field of the Invention

This invention relates to a multiple piece domino-type game having interfitting elements for connecting one game piece to the next adjacent game piece. The game may be played for amusement or entertainment or it may be used as an educational tool to teach simple geometry and arithmetic, visual acuity and manual dexterity. Although the game may be played by children of all ages and adults, it is especially suited for play by young children who have not yet learned simple numbers, and by the visually handicapped.

2. The Prior Art

The origins of domino-type games extend back into the dim recesses of antiquity. Modified versions of domino-type games, and particularly domino-type games having interfitting game pieces, have been the subject of a number of U.S. patents.

For example, Kremer U.S. Pat. No. 3,773,327 shows a domino-type game in which the numerical value of one half of the piece is represented in one design form and the numerical value of the other end of the piece is represented in a different design form, in this instance squares and animals. The pieces of the same numerical value, of either form, interlock through mating male and female members of different spacing. That is, only pieces of the same numerical value will mate and interlock together. Two different forms of interlocking members are shown, slots and projections or pegs and apertures.

Ellison U.S. Pat. No. 2,937,874 shows a domino-type game in which the ends of the pieces have different mating geometric shapes. The object of Ellison's game is somewhat different from ordinary dominoes. Instead of matching number for number, the matched pieces total six. Thus, the game pieces whose ends represent six and zero mate. Those representing five and one, four and two, and three and three, also mate.

Kramer U.S. Pat. No. 3,924,859 shows interlocking domino-type game pieces. In this instance, the interlocking elements are the same. That is, adjacent pieces will mate even though the corresponding numbers do not match.

SUMMARY OF THE INVENTION

Because it is a domino-type game, and is intended to be played in generally the same manner, the game of the present invention shares certain common features with ordinary domino games and those of the prior art patents. However, the present game incorporates specifically distinctive structural features.

Broadly stated, the invention is directed to apparatus for playing a domino-type game comprising a plurality of domino-like pieces intended to be joined end-to-end or end-to-side. Each of the game pieces is flat. They are of substantially equal length and thickness, and have parallel substantially equally spaced apart sides. Each of the game pieces has one of a plurality of different interfitting geometric configurations at at least one end which is matable with a complementary geometric configuration in the end or side of another game piece to connect adjacent pieces. Each of the game pieces is structurally distinctive and different from each other game piece. Certain of the geometric configurations comprise a single geometric element and others of the geometric configurations have a plurality of geometric elements. Complementary male and female geometric configurations on the game pieces are equal in number. Certain of the game pieces are doubles in the sense of having the same male or female geometric configuration at each end. Two of the game pieces have only a single geometric configuration at one end, the other end of the game piece being plain or flat. Certain of the game pieces have a female geometric configuration in one side adjacent one end of the game piece and either a male or female geometric configuration at the opposite end.

BRIEF DESCRIPTION OF THE DRAWINGS

The invention is illustrated in the accompanying drawings in which corresponding parts are identified by the same numerals and in which.

DESCRIPTION OF THE PREFERRED EMBODIMENT

Figure 1:
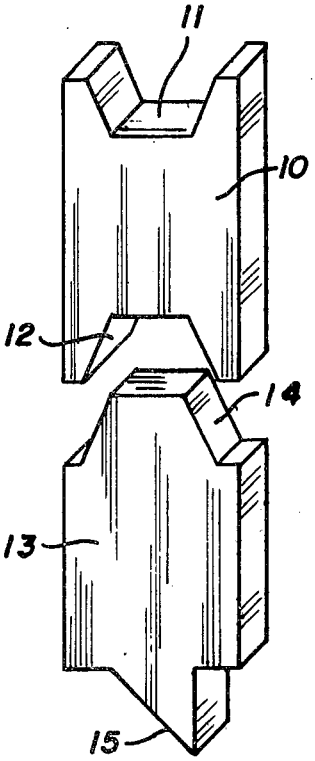
FIG. 1 is an isometric view showing the manner in which two adjacent game pieces mate and fit together.

Referring now to the drawings, and particularly to FIG. 1, the game pieces comprising the apparatus for playing the domino-type game of the present invention are flat block elements of substantially uniform overall length, width and thickness. The game pieces may be formed from a variety of materials including synthetic resinous plastic, wood, ceramic, ivory, and the like. The game pieces are preferably molded or cut or otherwise formed so as to have proportions of about one unit in width, two units in length, and about one-eighth to three-eighths unit in thickness. For example, a typical game piece may be 1 inch wide, 2 inches long, and $\frac{1}{4}$ inch thick.

FIG. 1 shows the manner in which adjacent game pieces are interconnected. A first game piece 10 (game piece No. 24, FIG. 3-D) is a "double" in the sense that it has identical geometric configurations 11 and 12 at each end (these being the female component of joint C, FIG. 2) The game piece identified at 13 (game piece No. 38, FIG. 3-G) has two different geometric configurations 14 and 15, the first of these being the male component of joint C, FIG. 2, and the other being the male component of joint A, FIG. 2. As is readily apparent, geometric configuration 12 complements and mates with geometric configuration 14 to connect the two pieces together in an interlocking joint.

Figure 2:
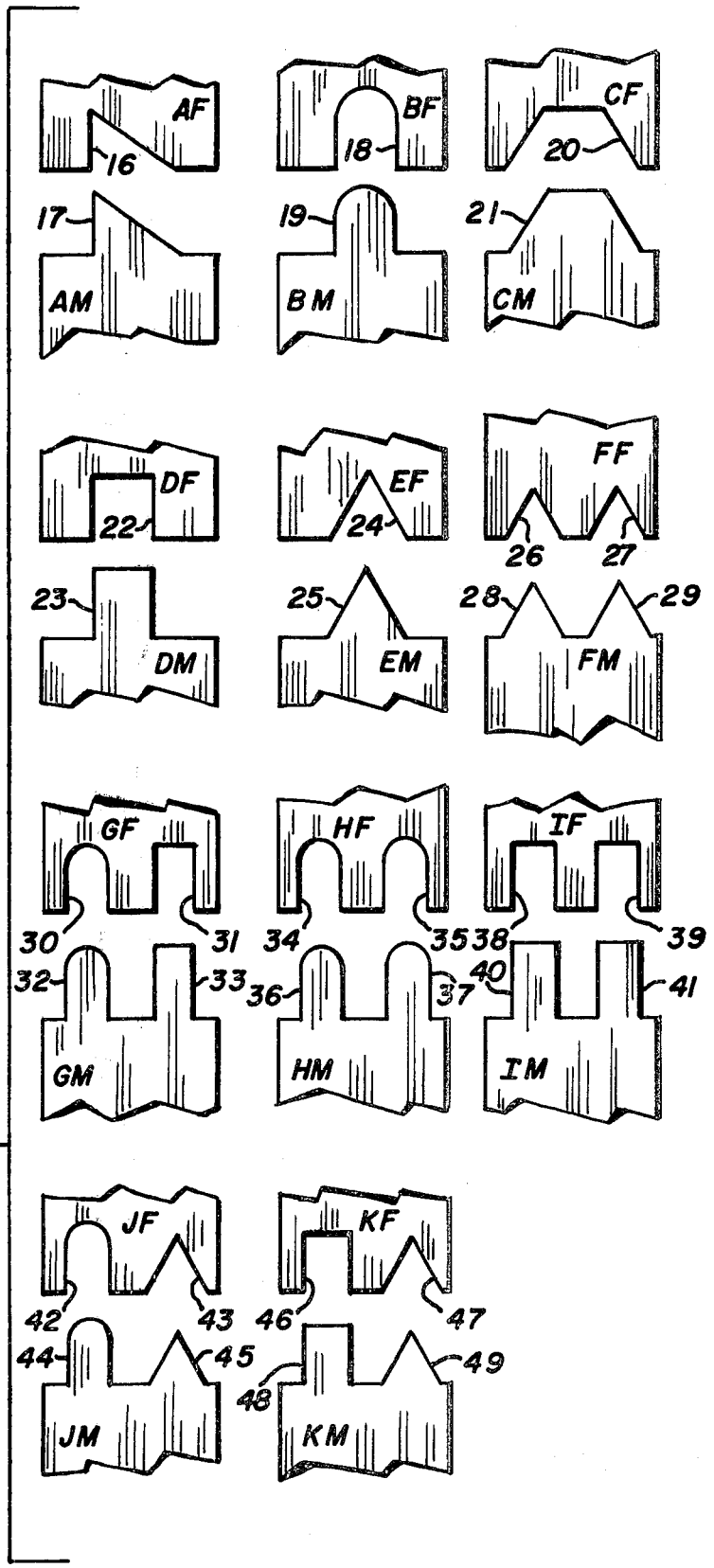
FIG. 2 is a series of fragmentary top plan views showing various geometric configurations or joints by which adjacent game pieces may be connected.
Figure 3A:
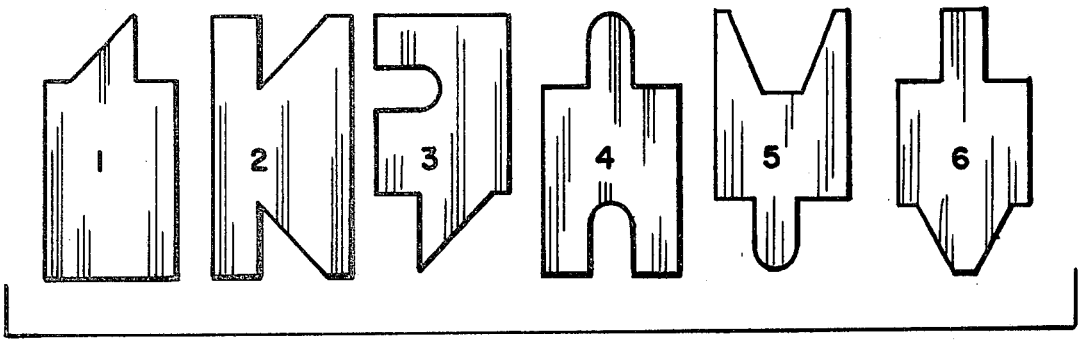
FIGS. 3A through 3H are plan views of all of the forty-eight different game pieces comprising one exemplary form of the domino-type game.
Figure 3B:
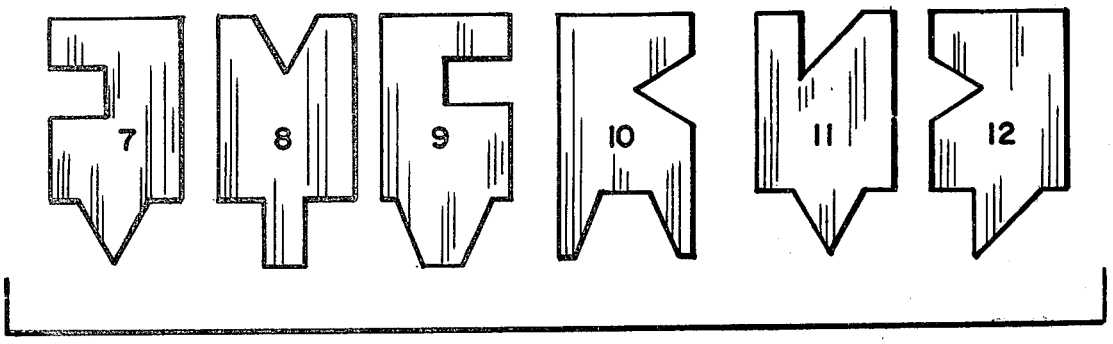
Figure 3C:
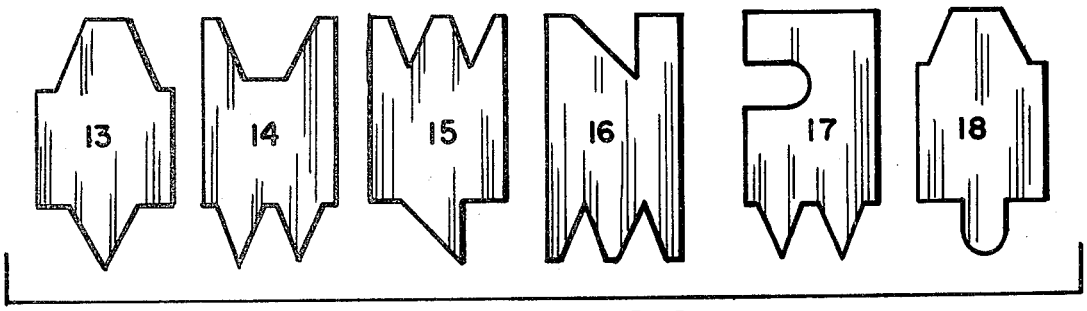
Figure 3D:
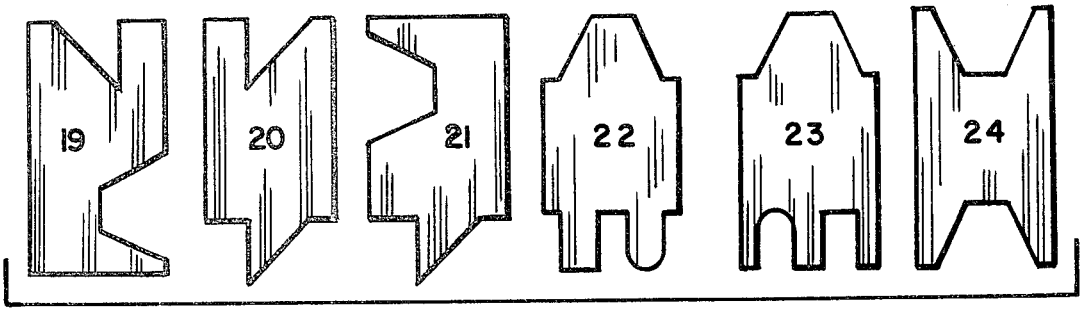
Figure 3E:
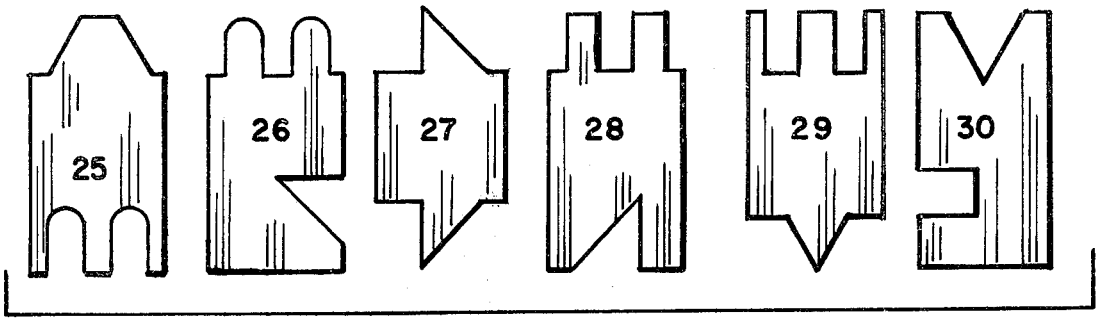
Figure 3F:
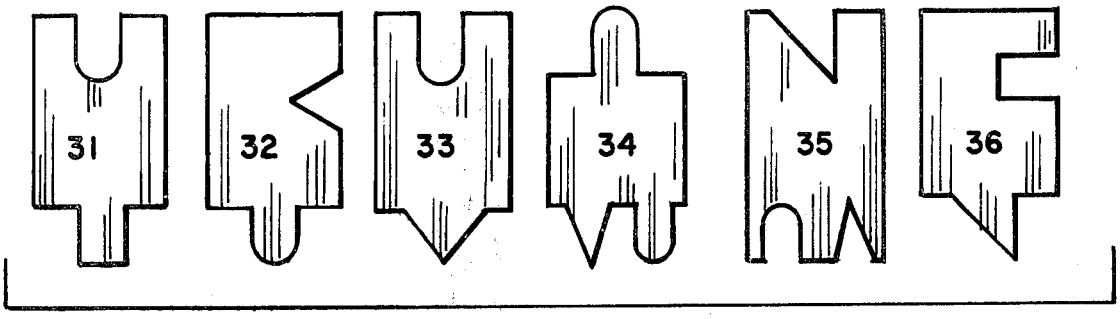
Figure 3G:
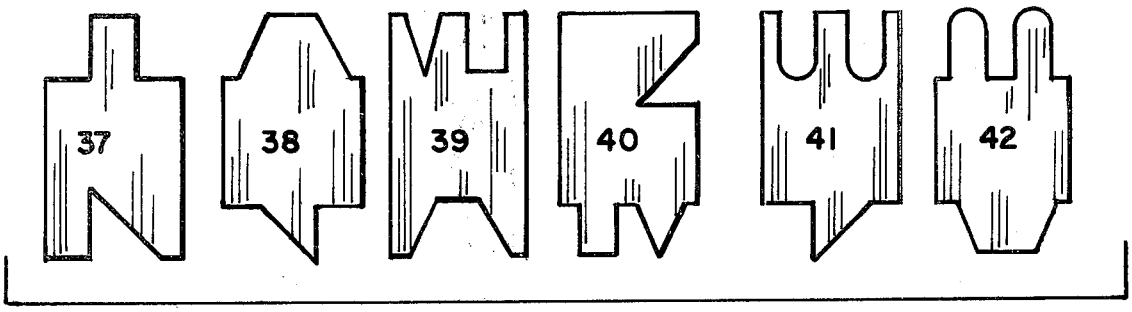
Figure 3H:
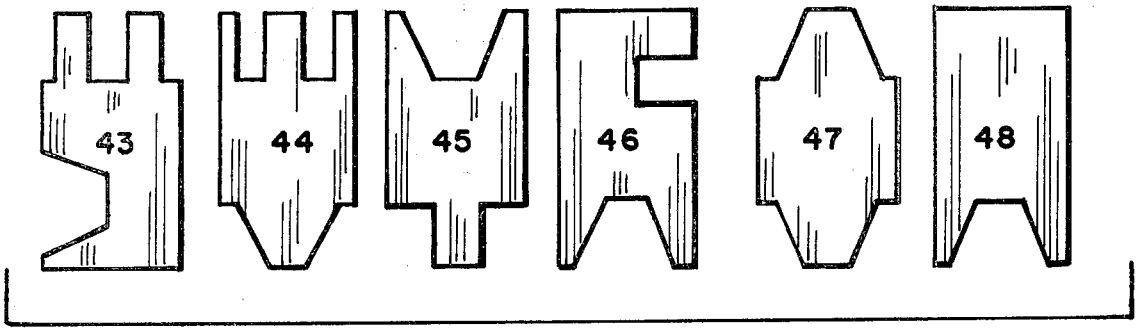

Referring to FIG. 2, there are shown the male and female geometric configurations or joint components A through K. Of these, geometric configurations A through E each include a single geometric element and geometric configurations F through K each include a pair of geometric elements. Each joint includes a female geometric configuration identified as F and a complementary mating male geometric configuration identified as M. Thus, joint or connection A is formed by mating a game piece including geometric configuration AF, which includes a right triangular recess 16, with a game piece having a geometric configuration AM having a right triangular projection 17 which complements and mates with recess 16. Joint B is formed with a game piece having geometric configuration BF in the form of a tongue-like recess 18 having a semi-circular end and a game piece with geometric configuration BM in the form of a complementary projecting tongue BM.

In the same manner, geometric configuration CF has a trapezoidal recess 20 and geometric configuration CM has a trapezoidal projection 21. Geometric configuration DF has a square or rectangular recess 22 and geometric configuration DM has a complementary rectangular or square projection 23. Geometric configuration EF has an isosceles triangular recess 24 and geometric configuration EM has a complementary isosceles triangular projection 25.

The geometric configurations making up joints F through J each have a pair of geometric elements. Thus, joint F is formed by mating two game pieces, one of which has geometric configuration FF in the form of spaced apart isosceles triangular recesses 26 and 27, and a second game piece having geometric configuration FM in the form of a pair of isosceles triangular projections 28 and 29. Joint G is formed between game pieces having geometric configuration GF in the form of one rounded tongue recess 30 and spaced apart rectangular recess 31 mating with a game piece having geometric configuration GM in the form of a rounded tongue projection 32 and spaced apart rectangular projection 33.

Similarly, geometric configuration HF is composed of a pair of rounded tongue recesses 34 and 35 which mate with geometric configuration HM composed of a pair of rounded tongue projections 36 and 37. Geometric configuration IF is composed of a pair of rectangular recesses 38 and 39 and geometric configuration IM is composed of a pair of rectangular projections 40 and 41. Geometric configuration JF is composed of the combination of a rounded tongue recess 42 and an isosceles triangular recess 43, and geometric configuration JM is composed of a rounded tongue projection 44 and isosceles triangular projection 45. Finally, geometric configuration KF is composed of a rectangular recess 46 and isosceles triangular recess 47, and geometric configuration KM is composed of rectangular projection 48 and isosceles triangular projection 49.

In one exemplary form of the game, as illustrated in FIGS. 3A through 3H, there are a total of 48 game pieces. Each piece is different. That is, no two pieces have the same combination of geometric configurations. Four of the pieces are doubles. Two of the pieces (Nos. 2 and 24) have the same female geometric configuration at each end and two (Nos. 27 and 47) have the same male geometric configuration at each end. Two of the game pieces (Nos. 1 and 48) are end pieces having a geometric joint-forming configuration at one end and being flat at the other. Although the majority of the pieces have their joint forming geometric configurations at the ends to permit aligning the game pieces end-for-end, 13 of the game pieces have one female or male geometric configuration at one end and another female geometric configuration in one side adjacent the opposite end of the game piece. Game piece No. 3 is illustrative. This permits the game to be played on a table top or floor area of reasonable size in that the game pieces may be interfitted along a flow path which changes direction so as to permit the pieces to be positioned in a more compact area.

The distribution of the various geometric configurations among the game pieces is set out in the Table:

TABLE I

| Game Piece No. | Geometric Configuration | Game Piece No. | Geometric Configuration |
|---|---|---|---|
| 1 | A-M; Flat | 25 | C-M; H-F |
| 2 | A-F - Double | 26 | H-M; A-F-side |
| 3 | A-M; B-F-side | 27 | A-M - Double |
| 4 | B-M; B-F | 28 | A-F; I-M |
| 5 | B-M; C-F | 29 | E-M; I-F |
| 6 | C-M; D-M | 30 | E-F; D-F-side |
| 7 | E-M; D-F-side | 31 | B-F; D-M |
| 8 | D-M; E-F | 32 | B-M; E-F-side |
| 9 | C-M; D-F-side | 33 | B-F; E-M |
| 10 | C-F; E-F-side | 34 | B-M; J-M |
| 11 | A-F; E-M | 35 | A-F; J-F |
| 12 | A-M; E-F-side | 36 | A-M; D-F-side |
| 13 | C-M; E-M | 37 | A-F; D-M |
| 14 | C-F; F-M | 38 | A-M; C-M |
| 15 | A-M; F-F | 39 | C-F; K-F |
| 16 | A-F; F-F | 40 | K-M; A-F-side |
| 17 | F-M; B-F-side | 41 | A-M; H-F |
| 18 | B-M; C-M | 42 | C-M; H-M |
| 19 | A-F; C-F-side | 43 | I-M; C-F-side |
| 20 | A-M; A-F | 44 | C-M; I-F |
| 21 | A-M; C-F | 45 | C-F; D-M |
| 22 | C-M; G-M | 46 | C-F; D-F |
| 23 | C-M; G-F | 47 | C-M - Double |
| 24 | C-F - Double | 48 | C-F; Flat |

Eighteen of the game pieces have a female geometric configuration at one end and a male configuration at the other. Four of the game pieces have a different female geometric configuration at each end; seven of the game pieces have a different male geometric configuration at each end. Each female geometric configuration has an equal number of counterpart male geometric configurations. The number of occurrences of each geometric configuration is shown in Table II:

TABLE II

| | | | | |
|---|---|---|---|---|
| AF - 11 | AM - 11 | GF - | 1 | GM - 1 |
| BF - 5 | BM - 5 | HF - | 2 | HM - 2 |
| CF - 12 | CM - 12 | IF - | 2 | IM - 2 |
| DF - 5 | DM - 5 | JF - | 1 | JM - 1 |
| EF - 5 | EM - 5 | KF - | 1 | KM - 1 |
| FF - 2 | FM - 2 | Flat - | 2 | |

Figure 4:
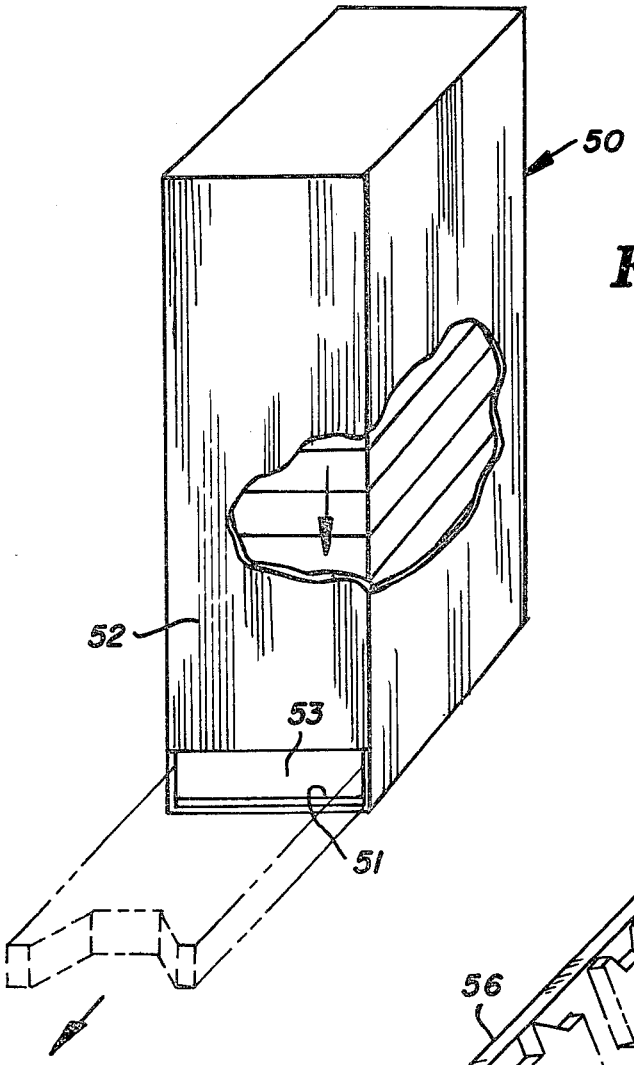
FIG. 4 is a perspective view of a preferred form of dispensing receptacle in which the game pieces may be packaged.

The game pieces are desirably packaged in a telescoping rectangular paperboard or cardboard box, such as shown in FIG. 4. The bottom portion 51 of box 50 has about the same height and width proportions as the game pieces and its length is approximately equal to the sum of the thicknesses of the game pieces. In this manner, all of the game pieces may be conveniently fitted with a slide fit into the bottom portion of the box for shipment and storage. The telescoping cover 52 of the box has a dispensing slot 53 at one end whose length is equal to the width of the box and whose width is just slightly larger than the thickness of one game piece. Thus, the game pieces may be dispensed from the box one at a time in a random fashion, dependent upon the random manner in which the game pieces are placed in the box. A finger slot or notch may be provided adjacent to dispensing slot 53 to facilitate easing the game piece from the box. A player needing an additional game piece to stay in the game must draw from the randomly distributed game pieces in the box, without any opportunity for picking or choosing a particular game piece having a particular desired geometric configuration. Although the illustrated box 50 is one unit wide and two units high, it may alternatively be two units wide and one unit high. The box is preferably about six to eighteen units in length, dependent upon the thickness of the game pieces, such that the box will contain one full set of 48 pieces. For example, if the pieces are $\frac{1}{8}$ unit in thickness, a box six units long will accommodate one set; if the pieces are $\frac{3}{8}$ unit thick, it will take a box eighteen units long to accommodate a complete set.

More expensive domino sets are often packaged in a wooden box with a sliding dove-tailed cover panel. If such a box is used, then the cover need be opened only far enough to permit the removal of one game piece and thus form a dispensing slot. Alternatively, the game pieces may be packaged in a sack or bag, from which they may be withdrawn blindly.

Figure 5:
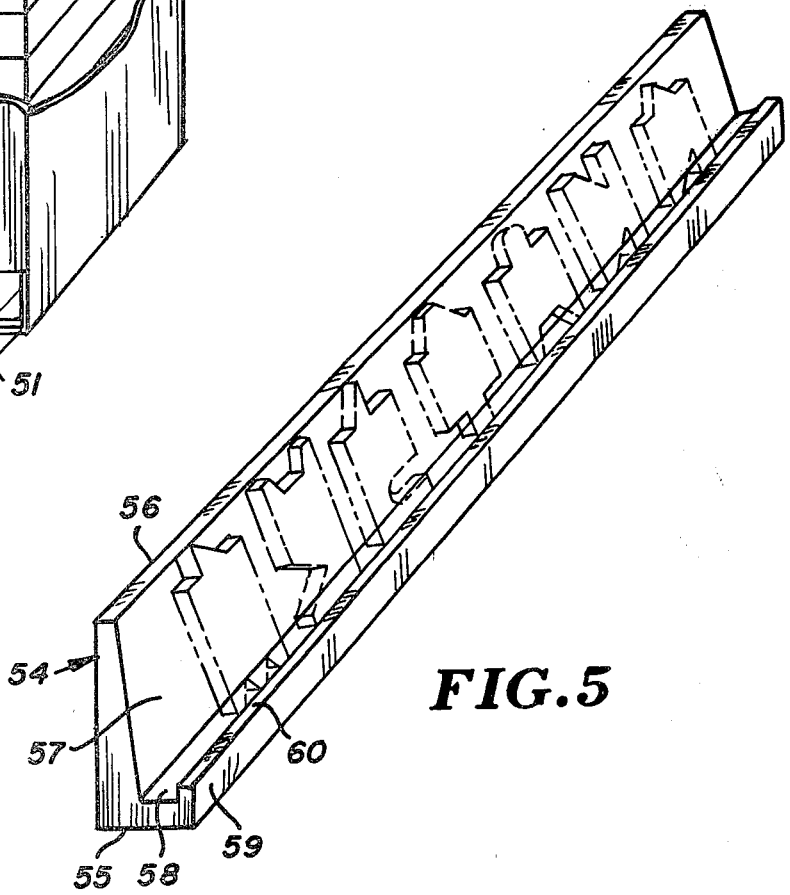
FIG. 5 is a perspective view of a preferred form of rack for holding a number of game pieces during play.

Because the game pieces in each hand of a player may be readily identified by sight by its particular geometric configuration, in order that players may not know which game pieces other players have, the players are preferably provided with racks or stands 54 similar to that illustrated in FIG. 5. The rack 54 has a base 55 and a vertical back wall 56 preferably of a height slightly greater than the length of each game piece. The front face 57 of the back wall preferably has a slight slope to keep the game pieces in place as they rest on one end in a bottom channel or trough 58 where they are retained by a vertical front wall 59 whose top edge 60 functions as a retaining lip. In this manner, the game pieces of one player may be shielded from the view of others.

The domino-type game of the present invention is played similarly to conventional dominoes. A fixed number of game pieces are randomly distributed to each player. Depending upon the number of players, each may initially be given five game pieces or seven game pieces, or the like, as desired. In this form of game, if a player may not interfit any of his game pieces with those already on the board he must go to the box or "bone-pile" and withdraw additional pieces until either he has a playable game piece or the supply of game pieces is exhausted. Alternatively, all of the game pieces may be equally distributed among the players initially, i.e., four players each receive 12 game pieces initially. As another alternative, certain of the game pieces are left out of play, i.e., 12 pieces each may be distributed to three players leaving 12 pieces out of play in a particular game.

Play begins in the usual manner with one player beginning the game by laying out a double. Then the play proceeds by rotation with the next player adding a game piece with a geometric configuration complementary to that of the double already in play. The play then continues in rotation with each player adding a game piece either until one person is out of pieces or until further play is no longer possible because no player has a game piece with a proper matching geometric configuration.

To facilitate scoring, numerical values may be assigned to the geometric configurations. For example, a geometric configuration having a single geometric element, as in configurations A through E, and exemplified by game piece No. 1, may have an arbitrary assigned value of 2. Because game piece No. 1 is flat on one end, the value of that piece would be 2. A geometric configuration having a pair of geometric elements, as in configurations F through K, may be assigned an arbitrary value of 4. Thus, a game piece such as No. 7 having one single element configuration and one double element configuration, would have a value of 6. A double game piece might have an arbitrary value of 10. Thus, relative scores may be attained by each player with the player having the lowest score value being the winner.

Obviously many variations are possible of the manner in which the game is played. Young children whose knowledge or arithmetic is limited would most likely ignore game piece values and merely count individual game pieces.

As will be recognized, because game pieces No. 1 and No. 48 are flat on one end, the placing of either of these in play immediately closes that end of the sequence of game pieces from further play, reducing the opportunities for the next players in rotation being able to dispose of their game pieces.

The game pieces have no right side or wrong side. For example, in the case of a game piece having a non-symmetrical geometric configuration such as that in joint J, it is immaterial which element is to the left and which is to the right. The appropriate mating game piece may simply be turned over if the elements are not in appropriate mating relationship.

A particular feature of the game of the present invention is that it may be played by visually handicapped people. The characteristics of the geometric configurations are easily recognizable by touch. Where scoring is desired, the assigned values can also readily be discerned by touch based on the single or plural geometric elements.

It is apparent that many modifications and variations of this invention as hereinbefore set forth may be made without departing from the spirit and scope thereof. The specific embodiments described are given by way of example only and the invention is limited only by the terms of the appended claims.

The embodiments of the invention in which an exclusive property or privilege is claimed are defined as follows:

1. Apparatus for playing a domino-type game comprising a plurality of domino-like game pieces:

(A) each of said game pieces being flat and of substantially equal length and thickness, (B) each of said game pieces having parallel substantially equally spaced apart sides, (C) each of said game pieces having one of a plurality of different interfitting geometric configurations at at least one end matable with a complementary geometric configuration in another of said game pieces to connect adjacent pieces, (D) each of said game pieces being structurally distinctive and different from each other game piece, (E) certain of said geometric configurations comprising a single geometric element and other of said geometric configurations having a plurality of geometric elements, (F) complementary male and female geometric configurations on said game pieces being equal in number, (G) certain of said game pieces being doubles in the sense of having the same male or female geometric configuration at each end, and (H) two of the game pieces having only a single geometric configuration at one end, the other end of the game piece being flat.

2. Apparatus according to claim 1 wherein certain of said game pieces have one geometric configuration at one end and another female geometric configuration in one side adjacent the opposite end of the game piece.

3. Apparatus according to claim 1 wherein said different geometric configurations are eleven in number, five of said geometric configurations comprising a single geometric element and six of said geometric configurations comprising a pair of geometric elements.

4. Apparatus according to claim 1 wherein said game pieces are in the relative proportions of about one unit in width, about two units in length and about one-eighth to three-eighths unit in thickness.

5. Apparatus according to claim 1 wherein said game pieces are contained in a closed dispensing receptacle whose height and width correspond to the length and width of the game pieces, whose length corresponds to the total thickness of the game pieces, one end of one wall of said receptacle having a dispensing slot therein, said slot having a length corresponding to the length or width of a game piece and a width corresponding to the thickness of a game piece.

6. Apparatus according to claim 1 wherein:

(A) said game pieces are forty-eight in number, (B) four of said game pieces are doubles, (C) thirteen of said game pieces have one geometric configuration at one end and another female geometric configuration in one side adjacent the opposite end of the game piece, (D) four of said game pieces have a different female geometric configuration at each end, (E) seven of said game pieces have a different male geometric configuration at each end, and (F) eighteen of said game pieces have female geometric configurations at one end and male geometric configurations at the opposite end.

7. Apparatus according to claim 6 wherein two of said doubles have female geometric configurations at each end and two of said doubles have male geometric configurations at each end.

8. Apparatus according to claim 6 wherein one of the game pieces having only a single geometric configuration has a female geometric configuration at one end and the other of said game pieces has a male geometric configuration at one end.

9. Apparatus according to claim 6 wherein said different geometric configurations are eleven in number, five of said geometric configurations comprising a single geometric element and six of said geometric configurations comprising a pair of geometric elements.

10. Apparatus according to claim 6 wherein said game pieces are in the relative proportions of about one unit in width, about two units in length and about one-eighth to three-eighths unit in thickness.

11. Apparatus according to claim 10 wherein said game pieces are contained in a dispensing receptacle about two units in height, about one unit in width and about six to eighteen units in length, one end of one wall of said receptacle having a dispensing slot therein, said slot being about one unit in length and about one-eighth to three-eighths unit in width, whereby a single game piece may be dispensed from the receptacle.

12. Apparatus according to claim 10 wherein said game pieces are contained in a dispensing receptacle about one unit in height, about two units in width and about six to eighteen units in length, one end of one wall of said receptacle having a dispensing slot therein, said slot being about two units in length and about one-eighth to three-eighths unit in width, whereby a single game piece may be dispensed from the receptacle.

* * * * *